US005345222A

United States Patent [19]

Davies et al.

[11] Patent Number: 5,345,222

[45] Date of Patent: Sep. 6, 1994

[54] DETECTION APPARATUS FOR SECURITY SYSTEMS

[75] Inventors: Dafydd G. Davies, Cambridge, United Kingdom; Leif Asbrink, Vingåker, Sweden

[73] Assignee: Esselte Meto International Produktions GmbH, Hirschorn am Neckar, Fed. Rep. of Germany

[21] Appl. No.: 768,327

[22] PCT Filed: Feb. 28, 1991

[86] PCT No.: PCT/GB91/00307

§ 371 Date: Dec. 26, 1991

§ 102(e) Date: Dec. 26, 1991

[87] PCT Pub. No.: WO91/13413

[30] Foreign Application Priority Data

Feb. 28, 1990 [GB] United Kingdom ..... 9004431.4

[51] Int. Cl.[5] ..... G08B 13/24

[52] U.S. Cl. ..... 340/572; 340/551; 343/841; 343/842; 343/894

[58] Field of Search ..... 340/572, 551; 343/842, 343/841, 894

[56] References Cited

U.S. PATENT DOCUMENTS

| | | | |
|---|---|---|---|
| 4,166,264 | 8/1979 | Starr | 340/551 |
| 4,623,877 | 11/1986 | Buckens | 340/551 |
| 4,769,631 | 9/1988 | Copeland | 340/572 |
| 5,061,941 | 10/1991 | Lizzi et al. | 340/572 |

FOREIGN PATENT DOCUMENTS

| | | |
|---|---|---|
| 352513A2 | 1/1990 | European Pat. Off. . |
| 3820353 | 12/1989 | Fed. Rep. of Germany . |

OTHER PUBLICATIONS

EPO Search Report on European counterpart of this application.

*Primary Examiner*—Glen R. Swann, III

*Attorney, Agent, or Firm*—Sixbey, Friedman, Leedom & Ferguson

[57] ABSTRACT

An electronic article surveillance system is provided that comprises a core-wound drive coil which produces an AC magnetic interrogation field, and a detection coil provided on one side with at least one element of a screening material, which detection coil detects an AC magnetic response field generated by a magnetically active tag or marker which is subjected to the interrogation field when the tag or marker comes in proximity with the detection coil. The screening material may take the form of an open-ended electrically conductive box having an insulating gap along its length, or a laminate consisting of a plurality of metal foils interleaved with an electrically insulating material. The invention provides well-defined flux control for the detection coil which preventsinterference from unwanted external magnetic fields.

35 Claims, 5 Drawing Sheets

Fig. 3a.
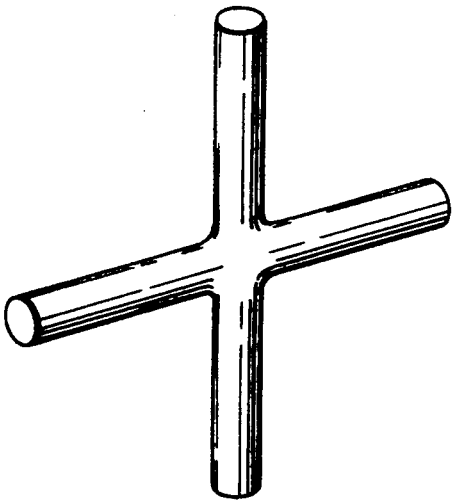
Fig. 3b.
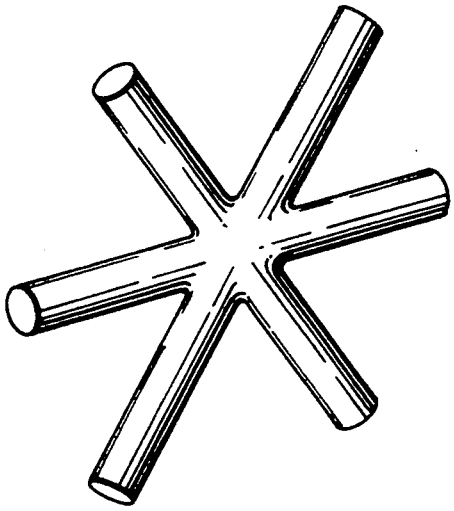
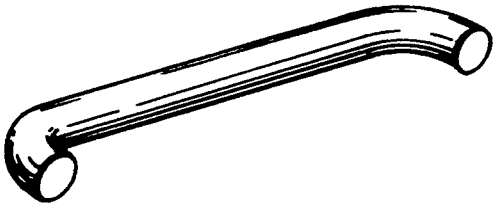
Fig. 3c.
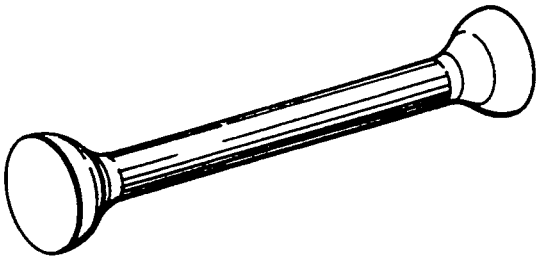
Fig. 3d.

DETECTION APPARATUS FOR SECURITY SYSTEMS

BACKGROUND OF THE INVENTION

This application relates to detection apparatus for security and surveillance systems, in particular but not necessarily exclusively for systems relying on magnetic detection of special markers or tags, which are often used in electronic article surveillance (EAS), e.g. in retail premises.

Detection systems in general use large, relatively flat, pile-wound, air-cored induction coils for reception of ac magnetic fields generated when tags pass through the detection zone. The coil axis is usually perpendicular to the direction of travel of persons walking through the detection zone, This type of detection system is prone to interference from external sources of ac magnetic fields such as cash registers, motors and electrical cables, since these will also induce voltages in the pick-up coils. These extraneous signals complicate the recognition of the signals from the markers, and generally cause false alarms or reduce the genuine detection rate. Additionally, this type of detection suffers from further unwanted signals which are generated by external (normally) 'passive' objects such as iron and steel panels or other metal fixtures close to the detection volume, since these objects are driven to produce unwanted magnetic: signals by the magnetic field which is generated by the EAS system, which is used to interrogate the tags in and around the detection volume.

Screen material can be employed to shield the air-cored detection coils from unwanted external signals, but these have to cover at least the entire area of the coil, so are expensive, cumbersome, difficult to install and aesthetically undesirable.

SUMMARY OF THE INVENTION

This invention is concerned, inter alia, with methods for reducing or eliminating these problems, and with apparatus constructed accordingly.

In accordance with one aspect of the invention, detection coils are used which have a ferromagnetic core of high permeability and low coercive force, suitable exemplary materials being soft ferrite, transformer steel or mumetal.

In one embodiment of the invention, the detector coil is wound onto a rod or long block of the core material. This will produce substantially the same performance in the far- and mid-field as a dipole air-cored detection coil of diameter equivalent to the length of the core rod or block.

The solid cored coil has advantages of lower overall size, but the primary advantage in accordance with this invention is that the magnetic flux entry points to the detection coil are considerably more confined, being located at the tips of the core rather than spread out over the entire plane of the air-cored coil. This means that the position of flux entry and exit may be easily manipulated and moved around by moving or shaping the ends of the core. For example, the core ends may be pointed inwards to the detection zone to reduce sensitivity to external interference. The advantage of this well-defined flux control is that the receivers can be shielded more effectively from unwanted external fields, as described below.

Suitable core materials will generally have an effective relative magnetic permeability of between 1 and 10,000, preferably between 30 and 1000. The effective permeability may be governed either by intrinsic material properties or core shape, or a combination of the two. Typically, rod cross-sections will be a few $cm^2$ and rod length from 5–50 cm, although these dimensions are given as typical examples only.

Furthermore in accordance with, and as a preferred component of, this aspect of the invention small areas of screening material may be placed behind or around the flux entry points at the tips of the rod; these provide effective screening of the receive system for unwanted external systems. The quantity, and hence the weight and cost, of screening material is considerably less than is required for an air-cored coil, and the ease with which it can be manipulated is improved. Since only a small amount of material is needed, there may be gaps between screens, allowing lines of sight into the detection zone and hence improving the aesthetic appearance of the detection apparatus.

Suitable screens include (for example) plain metal sheet of thickness in the range 0.3 to 2.5 mm, typically about 1 mm, or laminated sheets, or perforated sheets or meshes. The screen material should preferably be non-ferromagnetic and a good conductor, such as one formed of copper, aluminum or stainless steel or other alloy with such qualities.

The choice of screen thickness will depend upon the operating and detection frequency of the EAS system. We have found that a versatile, cheap and lightweight screen can be made for a kHz frequency system by laminating together a plurality of sheets (typically ten sheets) of plain aluminum foil, similar to cooking foil, each separated by a layer of paper or other electrical insulator. In cases where the most effective screening is required, aluminum plates of thickness in the range of 0.1 mm to 3.5 mm, preferably 0.3 to 2 mm, are advantageously used.

A detection system constructed and screened according to this invention is relatively insensitive to external electrically-driven sources of noise, and may also be placed very close to otherwise troublesome iron panels or other ferromagnetic objects such as railings or checkout panels, thus increasing the performance and location versatility of the EAS system.

BRIEF DESCRIPTION OF THE SEVERAL FIGURES

Referring now to the drawings, FIG. 1 shows a schematic view of a solenoid wound receiver coil 12 on a magnetically permeable core 11 with screening elements 13.

FIG. 2 shows a schematic view of a pile-wound receiver coil 25 with a large screening element 24 behind it.

FIGS. 3*a* to 3*d* show various core geometries for receiver cores of this invention.

FIG. 4 shows a hollow cored receiver coil 41 wound onto an electrically conductive former 42 in the form of a hollow extruded aluminum member containing an insulating gap 43.

FIG. 5 shows a receiver coil 51 wound onto an aluminum foil flux trapper 53 insulated from itself by an insulating layer 52. The whole structure is wound onto an insulating former 54.

FIGS. 6*a* and 6*b* are perspective and cross-sectional views of a rearfield magnetic screen consisting of a first component 61, a second component 62, a drive coil 63;

this figure also illustrates a gap 64 which is formed in the first component 61.

FIGS. *7a* and *7b* are perspective and cross-sectional views of a single-element magnetic shield 71 constructed from a single component, with slits to minimise eddy current effects, and a drive coil 72. The two views are of similar projections to FIGS. *6a* and *6b*.

FIG. 8 shows an electronic article surveillance system.

DETAILED DESCRIPTION OF THE PREFERRED EMBODIMENT

Figure 1:
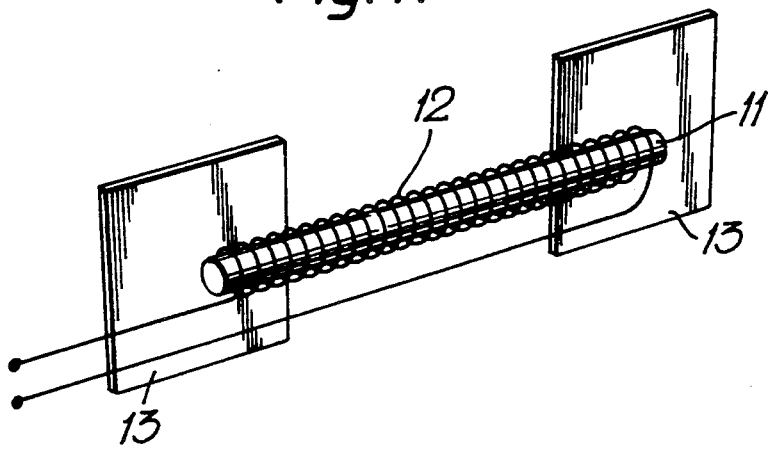
Figure 2:
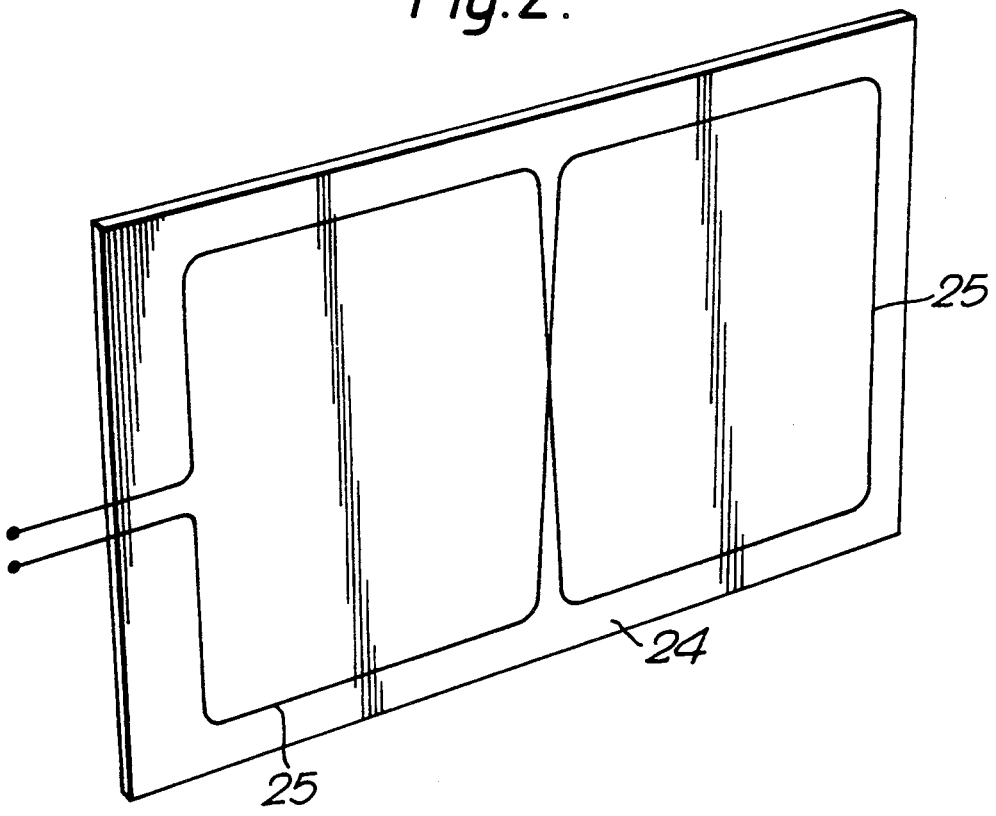

A representation of a screened solid cored coil 12 provided with screening elements 13 is shown in FIG. 1 (described in more detail hereinafter), while the equivalent screened air-cored coil 25 is shown in FIG. 2.

The solid core 11 may be shaped to further enhance its performance by flaring the tips or bending them inwards, or by forming a four-pointed or multiply pointed cruciform structure from the material, for example as shown in FIGS. *3a* and *3b* and described hereinafter.

In a second aspect, the invention provides a method for reducing the 'drive' or 'interrogation' magnetic field of the EAS system in the area outside the detection zone while increasing the field inside the detection zone. This has the simultaneous advantages of reducing the power requirement of the drive system and reducing the amplitude of extraneously-generated unwanted signal from external ferromagnetic objects excited by the drive field.

This is currently accomplished (e.g. as disclosed in U.S. Pat. No. 4,769,631) by the use of large sheets of non-conductive high permeability material which cover all or most of the area behind the drive coil. Because these materials (as proposed by prior inventions) generate considerable magnetic signal (response) themselves, prior inventions have had to rely on timing sequences for marker detection, which reduce the overall detectability of the markers.

According to a further aspect this invention, the rearward reduction of the interrogation field can be achieved by a shield 24 with a combination of high magnetic permeability and electrically conducting materials. A shield of this type can produce negligible interfering magnetic signal, particularly when used with screened detection coils 12 of this invention. In addition, the thickness and hence the weight of material required is less than in shields known from the prior art. According to a further aspect of this invention, the shield 24 consists of two components 61, 62; and the second component 62 is a larger, electrically conductive shield placed behind the first component 61 and covering all or most or most of the area enclosed by the drive coil 63.

The first component 61 is preferably a relatively thick section of low coercivity material (for example transformer steel or low-coercivity ferrite) placed close to but behind the drive coil 63. This first component 61 need not cover the whole area enclosed by the drive coil 63, but need only be a few centimeters in width (as indicated by way of example in FIGS. *6a* and *6b*). The purpose of this first component 61 is to reduce the field by magnetic flux conduction at the point where it is strongest: i.e. directly behind the drive coil 63. The first component 61 must not form a shorted turn for the drive coil—i.e. it must not be a continuously conductive loop or plane but must have a slit 64 or insulated gap. The magnetic flux which would normally pass into objects behind the coil 63 is diverted into the low reluctance component, and hence is confined and controlled.

The second component 62 is a larger, electrically conductive shield placed behind the first component 61 and covering all or most of the area enclosed by the drive coil 63 as shown in FIGS. *6a* and *6b*. The purpose of the second component 62 is to reduce the rearward residual weaker field, not deflected by the first component 61, by eddy current opposition.

The electrical conductivity of this second component 62 is desirably chosen not to produce too great a resistive loading on the drive circuitry. If in addition the second component 62 has magnetic flux conduction properties, then its efficacy is further enhanced. We have found that the properties required of the second component 62 are best met by sheets of steel. In particular magnetic stainless steels such as type 430 steel have particularly advantageous combinations of magnetic permeability and electrical conductivity. The high flux density which would otherwise cause significant loading and high levels of unwanted magnetic interference on passing into the second component 62 directly behind the coil 63 is diverted by the first component which is interposed between the two.

As an alternative embodiment of this invention, the function of the first and second components may be incorporated in a single element 71, such as a large sheet of material such as transformer steel or magnetic stainless steel which covers the entire area to the rear of the drive coil 72. In order to avoid resistive loading, however, the sheet will preferably be slit in a direction approximately radial to the drive coil 72, as shown in FIGS. *7a* and *7b*. To further improve the properties of this single element, the thickness may be increased close to the drive coil as shown in FIGS. *7a* and *7b*, e.g. by lamination or suitable joining of additional material.

In order to reduce acoustic noise which may be generated in these shield components, it will also be desirable to use additions of suitable sound-damping material such as self-adhesive acoustic deadening material, e.g. of the sort used by automobile manufacturers.

It should be noted that the advantage of the shielding material described above is that suitable choice of advantageous symmetric positioning of the shield with respect to the drive and receive coils renders it almost entirely passive—i.e. not producing unwanted magnetic signal on the receive circuitry.

As illustrated examples of the configuration of the shield, the first component 61 may be fabricated from transformer sheet steel such as 'Losil' sheet—in a thickness preferably between 0.25 mm and 1 mm (either in a single layer or in a laminated structure incorporating sound damping material).

The shield may be in the form of a single loop (with gap 64) or it may be fabricated from a number of discrete pieces more or less joined together to form a loop approximating to the shape in FIG. *6a*.

The second component 62 of, for example, type 430 stainless steel may be of a similar thickness to the first component 61. The first component 61 is placed between the coil 63 and the second component 62, and the separation between components is between 1 mm and 20 mm.

In an alternative aspect of this invention, the pick up coil 41 is wound onto a hollow, open ended conductive metal box 42, which is made with an insulating gap 43 along its length so that it should not form a shorted turn magnetically linked to the coil 41. Currents are induced in the box 42 so as to counter the emergence of magnetic flux along the length of the box 42, confining the position of the flux entry and exit points to the ends of the box 42.

The flux-confining box 42 may also be placed around the outside of the receiver coil 41 with equal effectiveness, provided that the box 42 is close-fitting onto the coil 41 (less than about 5 mm clearance). If the box 42 is placed outside the coil 41 then the box, if earthed, can also duplicate the function of an electrostatic screen for the receiver coil (against electrostatically-induced voltage pick up from external sources).

Figure 4:
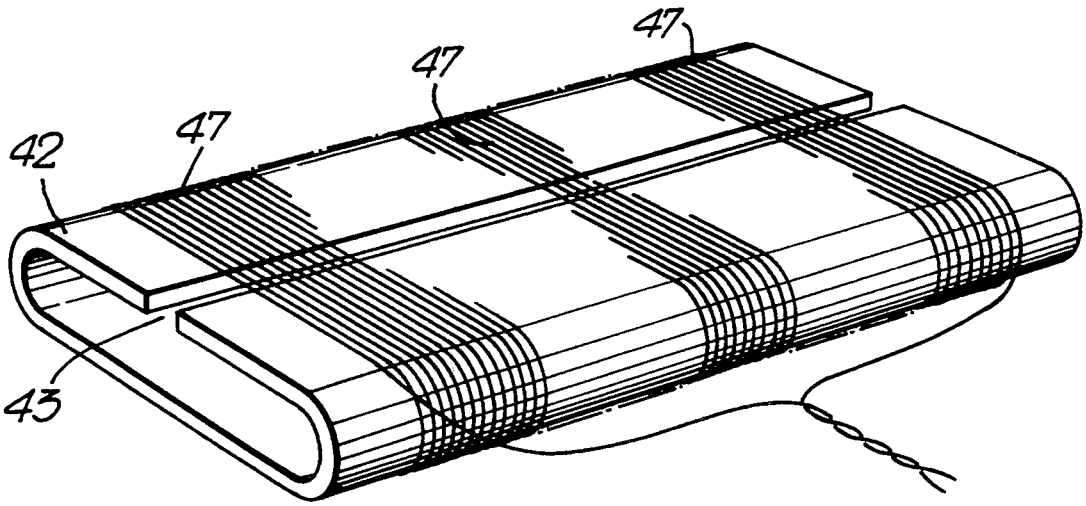
Figure 5:
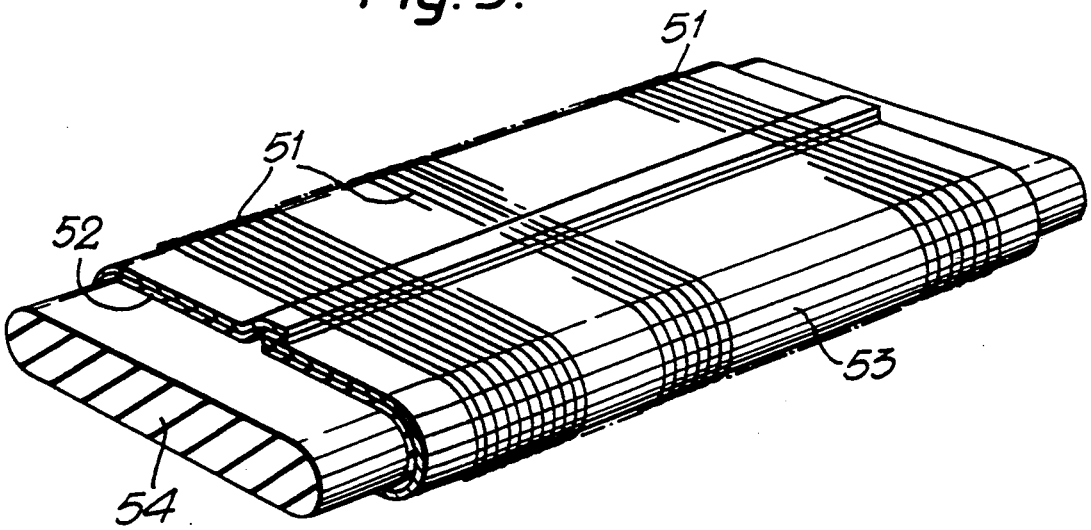
Figure 6A:
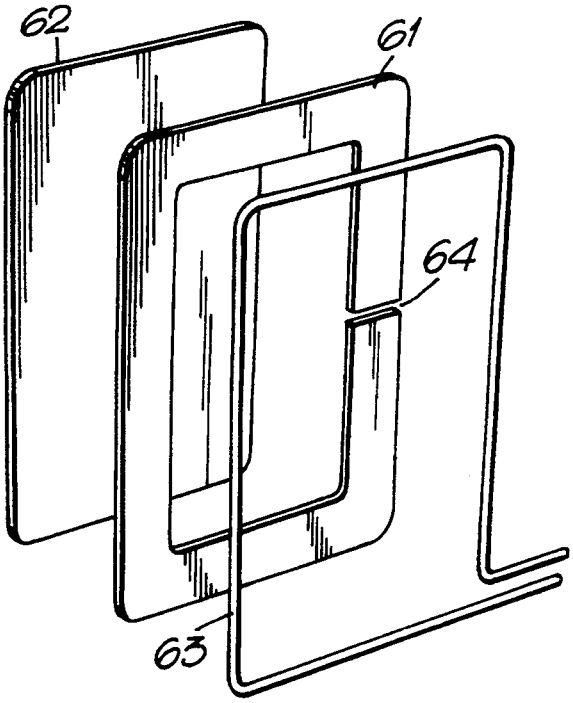
Figure 6B:
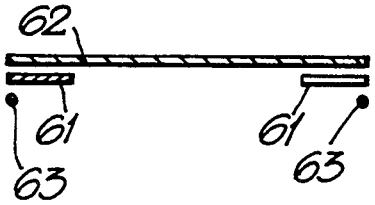
Figure 7A:
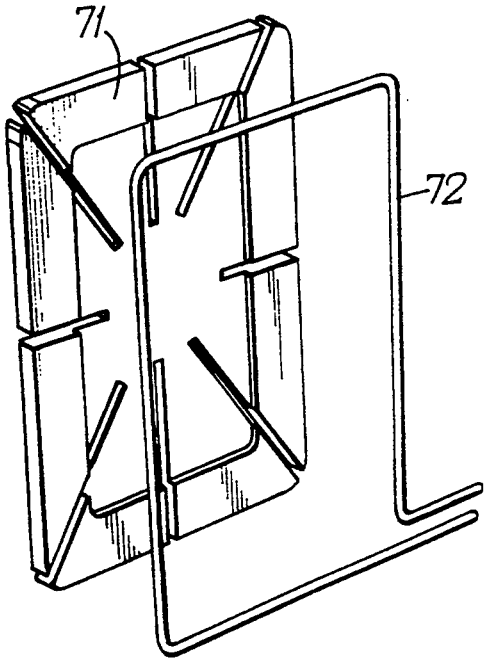
Figure 7B:
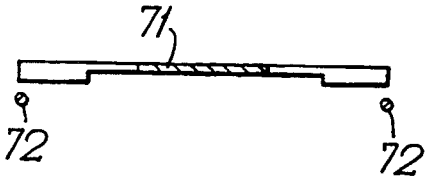

One example of a box 42 of this type is an extruded aluminum form with a small gap 43 along its length (FIG. 4). Alternatively, the box may consist of one or more insulated layers 53 of copper or aluminum sheet wound on an insulating former 52, 54, the coil 51 being wound round the whole (FIG. 5).

In certain circumstances, the conductive flux-containing box can be dispersed with altogether, since the windings of the detector coil act to a certain extent as a flux-confining box. It is important to note that the advantageous properties are only found for the solenoid-wound detector coils of the present invention, not for conventional pile-wound coils.

Because hollow coils do not contain nonlinear magnetic materials, this type of construction is applicable to regions where the magnetic fields are strong—such as, for example, very close to the drive coil. In fact, this construction can itself be used as a configuration for the drive coil of a security system.

The advantages discussed herein in relation to the ferrite detector apply equally to these devices.

Figure 8:
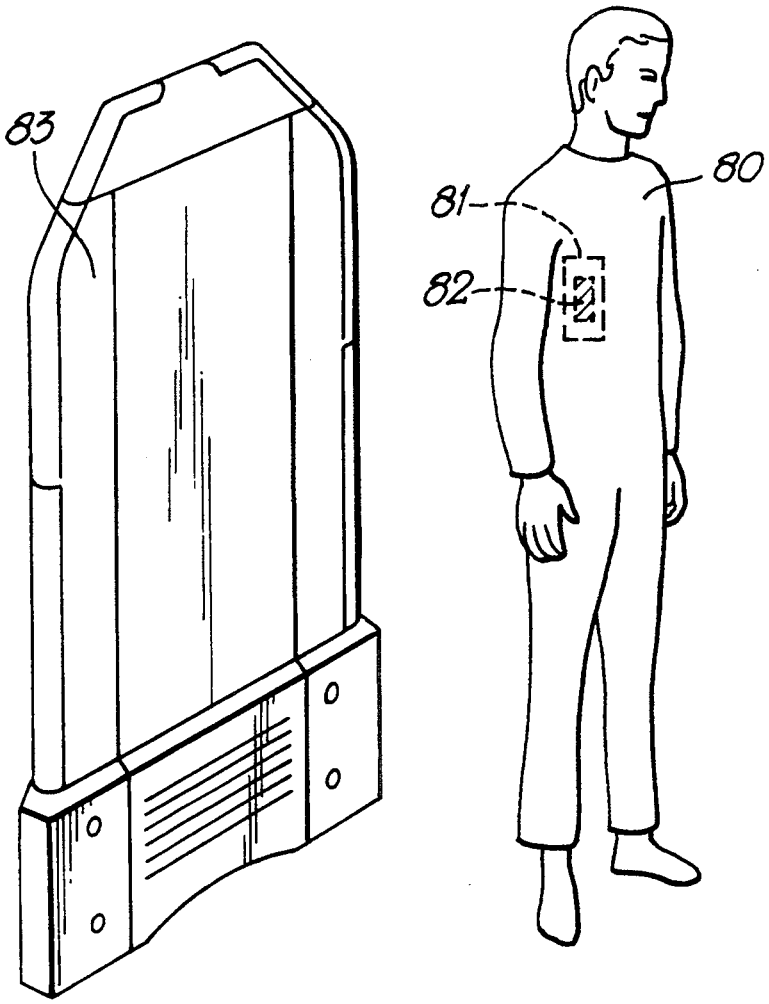

The detection apparatus described above forms part of an electronic article surveillance system as shown in FIG. 8. The gate 83 contains the various coils and shields, and includes electronic detection circuitry. A person 80, carrying an article 81 to which a marker 82 has been attached, will set off an alarm at the gate 83 unless the marker 82 is removed or deactivated, generally at the point of sale.

We claim:

1. An electronic article surveillance system comprising:

a. a drive coil which produces an AC magnetic interrogation field; and b. a core wound detection coil provided on one side with at least one element of a screening material, which detection coil detects an AC magnetic response field generated by a magnetically active tag or marker which is subjected to said interrogation field when said tag or marker comes into proximity with said detection coil.

2. A system as claimed in claim 1, wherein said screening material is located behind or around flux entry and/or exit point(s) to said detection coil.

3. A system as claimed in claim 1, wherein said screening material includes one or more metal sheets.

4. A system as claimed in claim 3, wherein said one or more metal sheets have a thickness in the range of 0.3 to 3.5 mm.

5. A system as claimed in claim 3, wherein said screening material comprises a laminate consisting of a plurality of metal foils interleaved with an electrically insulating material.

6. A system as claimed in claim 3, wherein said one or more metal sheets are formed of .materials which are non-ferromagnetic and electrically conductive.

7. A system as claimed in claim 6, wherein said one or more metal sheets are formed from one of the group consisting of copper, aluminum, and stainless steel.

8. A system as claimed in claim 1, wherein said core is formed of a ferromagnetic material with a magnetic permeability of between about 1 and 10,000 and about the same coercive force as that associated with soft ferrite, transformer steel and mumetal.

9. A system as claimed in claim 8, wherein said core is made from one of the group consisting of a soft ferrite, a transformer steel, and mumetal.

10. A system as claimed in claim 8, wherein said core has end regions which are shaped to provide one or more forwardly curving elements.

11. A system as claimed in claim 8, wherein said core comprises a plurality of radially extending members.

12. A system as claimed in claim 8, wherein said core is generally cruciform in form.

13. A system as claims in claim 8, wherein said core is shaped in the form of an elongate "C."

14. A system as claimed in claim 8, wherein said core has an effective relative magnetic permeability in the range of 30 to 1,000.

15. A system as claimed in claim 8, wherein said core has an axial length in the range of 5 to 50 cm.

16. A system as claimed in claim 1, wherein a shield formed of a material or materials which have a relative magnetic permeability in the range of 1 to 10,000 and are electrically conductive is provided on said one side of the coil.

17. A system as claimed in claim 16, wherein said shield consists of a single element covering all or substantially all of the area enclosed by the drive coil and the detection coil.

18. A system as claimed in claim 17, wherein said shield is formed from a laminated material or materials.

19. A system as claimed in claim 17, wherein said shield comprises a large sheet formed from one of the group consisting of transformer steel and magnetic stainless steel.

20. A system as claimed in claim 17, wherein said shield incorporates one or more slits which run from the edge of the shield towards the center of the shield.

21. A system as claimed in claim 17, wherein areas of the shield which are close to the drive coil are thickened by lamination or other suitable joining of additional shield material.

22. A system as claimed in claim 17, wherein said shield comprises first and second components.

23. A system as claimed in claim 22, wherein said first component comprises an element or elements formed from a material having substantially the same coercivity as "Losil" sheet steel and ferrite, said element or elements substantially covering only the region directly behind the coil on said one side and which does not form a continuously conductive loop.

24. A system as claimed in claim 22, wherein said first component is fabricated from one of the group consisting of transformer steel such as "Losil" sheet steel and ferrite.

25. A system as claimed in claim 22, wherein said first component has a thickness in the range 0.25 mm to 1.0 mm.

26. A system as claimed in claim 22, wherein said first component is a laminated structure incorporating sound damping material.

27. A system as claimed in claim 22, wherein said second component comprises an electrically conductive sheet which covers all or substantially all of the area behind said drive coil and said detection coil on said one side.

28. A system as claimed in claim 22, wherein said second component has magnetic flux conduction properties.

29. A system as claimed in claim 22, wherein said second component is fabricated from Type 430 stainless steel.

30. A system as claimed in claim 16, wherein said shield incorporates sound damping materials.

31. An electronic article surveillance system comprising:

a. a drive coil which produces an AC magnetic interrogation field; and b. a detection coil associated with an open-ended electrically conductive box having an insulating gap along its length, which detection coil detects an AC magnetic response field generated by a magnetically active tag or marker which is subjected to said interrogation field when said tag or marker comes into proximity with said detection coil.

32. A system as claims in claim 31, wherein said detection coil is wound around said box.

33. A system as claimed in claim 31, wherein said detection coil is wound within said box.

34. A system as claimed in claim 31, wherein said box is formed of aluminum.

35. A system as claimed in claim 31, wherein said box consists of one or more insulated layers of copper or aluminum sheet wound on an insulating former.

* * * * *